US005355761A

United States Patent [19]

Ward et al.

[11] Patent Number: 5,355,761

[45] Date of Patent: Oct. 18, 1994

[54] HEEL DRIVEN PEDAL ACTUATOR FOR PERCUSSION INSTRUMENTS SUCH AS HI-HAT CYMBALS AND THE LIKE

[75] Inventors: Susan D. Ward, Vancouver, Wash.; Keith M. Swartz, Scarsdale, N.Y.

[73] Assignee: Massachusetts Institute of Technology, Cambridge, Mass.

[21] Appl. No.: 12,203

[22] Filed: Feb. 2, 1993

[51] Int. Cl.[5] ..... G10D 13/02

[52] U.S. Cl. ..... 84/422.2; 84/422.3

[58] Field of Search ..... 84/402, 422.1, 422.2, 84/422.3, 453

[56] References Cited

U.S. PATENT DOCUMENTS

| | | | |
|---|---|---|---|
| 980,488 | 1/1911 | Carney | 84/422.1 |
| 2,672,784 | 3/1954 | Sabo | 84/422.1 |
| 3,464,305 | 9/1969 | Meazzi et al. | 84/422 R |
| 3,967,523 | 7/1976 | Currier et al. | 84/422 R |
| 4,381,690 | 5/1983 | Kimble | 84/422 R |
| 4,905,565 | 3/1990 | Hoshino | 84/422.3 |

OTHER PUBLICATIONS

Vruk product advertisement from Modern Drummer Magazine, May 1993.

*Primary Examiner*—Michael L. Gellner
*Assistant Examiner*—Patrick J. Stanzione
*Attorney, Agent, or Firm*—Steven J. Weissburg

[57] ABSTRACT

Disclosed is an actuator for a percussion instrument, such as a hi-hat cymbal, that is sounded by motion of a sound initiation member. The actuator includes a heel driven member, which translates vertically under the user's heel, and is connected to the sound initiation member, so that the user can activate the percussion instrument by moving the heel up and down. An inclined pedal that rotates about an axis may constitute the heel driven member. The connection between the heel driven member and the sound initiation member may be a hinged action lever, which is connected to the heel driven member so that it pivots in response to vertical heel motion. The action lever is connected to the sound initiation member by a cable, which is drawn in response to the pivoting motion of the action lever. The drawn cable pulls the sound initiation member, causing the instrument to sound.

12 Claims, 5 Drawing Sheets

HEEL DRIVEN PEDAL ACTUATOR FOR PERCUSSION INSTRUMENTS SUCH AS HI-HAT CYMBALS AND THE LIKE

The present invention relates generally to actuators for percussion instruments, and more specifically to a heel driven actuator for instruments such as hi-hat cymbals and bass drums.

BACKGROUND OF THE INVENTION

The hi-hat cymbal is one among many percussion instruments. A conventional hi-hat cymbal apparatus is shown schematically in FIG. 1. A light, upper cymbal 102 is closed down upon a heavier, lower cymbal 104 (not visible) in a vertical clapping motion, initiated by pressing down on one end of a pedal 106. All known hi-hat cymbal pedal actuators are designed to be driven by the drummer's toe. The apparatus as shown in FIG. 1 typically stands in front of the seated drummer. The hi-hat cymbal assembly must be located among the rest of the drummer's equipment so that the drummer may reach the cymbal with a drumstick and the pedal with his/her toe.

The typical pedal 106 has an elevated toe end, with the other end resting on the ground. The pedal is typically a simple plate of metal with traction grooves running across it.

The lower cymbal 104 is supported by a hollow central cylinder 110. The cylinder 110 is supported by the ground through a tripod 112. The upper cymbal 102 is secured to a center rod 114, which is typically about 0.2 in. (0.5 cm.) in diameter, and is concentric with and inside the central cylinder 110 and the lower cymbal 104. If the center rod 114 is moved up and down, the upper cymbal 102 also moves up and down, thus contacting and separating from the lower cymbal 104.

The bottom end of the center rod 114 attaches to the end of the pedal 106, near where the drummer's toe presses on the pedal, through a variety of different attaching mechanisms. (See FIGS. 2, 3 and 4.) The connection mechanism typically is attached to the pedal frame 116 for support. The pedal frame 116 acts as a base for the central cylinder 110 as well as a frame around the connection between the pedal 106 and the center rod 114. Because the central cylinder 110 is supported by tripod legs 112, it is possible to arrange the height of central cylinder 110 such that the bottom of frame 116 rests on the ground, or is suspended above the ground. A return spring (not visible) is mounted at the bottom of the central cylinder 110, and pushes up against a stop fixed to the center rod 114 near its bottom, to maintain the upper and lower cymbals separated from each other. Pressing on the pedal 106 compresses the spring, and brings the upper cymbal 102 down against the lower cymbal 104. Release of toe pressure allows the spring to push the center rod 114 up again, separating the cymbals.

A toe stop 118 prevents the drummer's toe from sliding forward, a common tendency. Stabilizer spikes 120 are usually located at either side of the pedal frame 116, to keep the entire assembly from sliding around when being played. Drummers often also place a carpet or other friction pad beneath the cymbal stand to further minimize sliding. Stabilizer bars 122 run from the heel end of the pedal 106 to the pedal frame 116, to prevent the pedal 106 from pivoting about the connection between the toe end of the pedal and the center rod 114.

Typically, the pedal rests at a 15 to 25 degree angle to the ground. The change in the pedal angle necessary to bring the upper and lower cymbals together is known as the "stroke." The drummer can typically choose the stroke within a range by varying the relative location between the upper and lower cymbals in their rest position. Once this stroke is chosen, it is not altered during play. The stroke is typically between 0.25 and 1.5 inches (0.64 to 3.8 cm) at the ball of the foot.

A high-hat cymbal is characterized by two subjective properties: (1) its "response time;" and (2) "sensitivity" or "feel." The response time relates to the speed with which the pedal returns to its rest position. A stronger return spring tends to decrease response time, but also increases player fatigue from repeated activation.

The sensitivity of a cymbal hi-hat is the drummer's perception of the pedal/cymbal relationship. There are many cymbal positions which must be maintained by a hi-hat, and a drummer needs to know exactly where the cymbals are at all times. This sensitivity is greatly affected by the pedal connection. Pedals which employ chains in the pedal connection have good sensitivity, or a "smooth feel," because the chain compensates for any misalignment, thereby removing any resulting friction which would affect the "feel." Another factor contributing to the sensitivity is the ratio of the stroke length to the distance of cymbal travel. Pedals with a higher ratio of stroke to cymbal travel are considered more sensitive, because they allow control of the cymbal with greater resolution. In other words, movement of a pedal with a relatively high ratio of stroke to cymbal travel moves the cymbal a relatively shorter distance than would the same movement of a pedal with a relatively lower stroke to cymbal travel ratio.

An exemplary hi-hat actuator must satisfy additional requirements. It is very important that the linkage be quiet and add only the least possible noise to the intended percussion sounds. It should also be durable, easy to use and light, particularly given that typical drum sets are otherwise quite heavy. The equipment should permit easy movement of the user's foot from a rest position to the active position. There should be no risk of foot interference with any of the mechanism.

Three known representative designs for hi-hat pedals are illustrated schematically in FIGS. 2A, 2B, 3A, 3B, 4A and 4B. (Other designs exist; however, these three show a great range of variations.) FIGS. 2A and 2B show the side and front elevations of a pedal design offered by many vendors. The central cylinder 210 houses the center rod 214, which is connected to pedal 206 through pedal connection 228. The pedal connection may be either solid or a chain. Other elements shown in FIGS. 2A and 2B, mentioned above include a heel rest 230, stabilizer rods 222, stabilizer spikes 220 and toe rest 218.

FIGS. 3A and 3B show schematically another type of hi-hat actuator, which is similar to the basic design; however, the pedal connection 328 includes a pulley 334 and chain 332. The pulley doubles the rotation stroke and allows the return spring force to be doubled over that of a pedal such as illustrated in FIGS. 2A and 2B, without increasing the required depression force.

A third known design also provides a mechanical advantage using a five-bar linkage rather than a pulley, as shown schematically in side and front elevations in FIGS. 4A and 4B. The center rod 414 is connected to the pedal 406 through chain 432 to pedal connection linkage 437, which is connected to pedal 406 through a solid piece 438. A return bar 436 connects the connection linkage 437 to a stationary reference.

A significantly different design is also known, but has acquired only minimal commercial success. This device has a pedal that is connected to the cymbal by a remote linkage, such as a metal cable of the type used to actuate bicycle brakes. This design is unpopular because there is significant friction, compliance and delay in the system, which significantly diminishes sensitivity and increases response time.

All of the known designs have drawbacks. The principal drawback is that they fatigue the user. It is also desirable to engage the cymbals with a high frequency and variable intensity or power. For some users, a higher frequency is desired than is comfortably possible, due to the fatigue problem mentioned above, and general coordination difficulties. Some users combat the fatigue by holding the toe in a fixed pointed position, and bouncing their entire leg, rather than just depressing the toe.

Known systems also suffer from a drawback known as "bounce." This is caused by a felt bumper between a stop at the end of the center rod 214 and a mating stop on either the pedal frame 216 or the central cylinder 210. When the return spring returns the center rod 214 to its open (highest) position, the felt, which is intended to soften the impact of the meeting of the two stops, is compressed. When this potential energy is released as the felt decompresses after the initial impact, the center rod undergoes one or two small bounces.

Another drawback of known devices is their limited flexibility of pedal placement relative to the drummer's seat. As already mentioned, there are typically only one or two acceptable cymbal locations. Further, the pedal can not be moved independent of the stand. This means that there are only one or two places where the drummer's foot can be placed to use the pedal, even though some drummers would prefer to locate the pedal closer to their body, others further from their body.

The present invention solves these problems, through a design that is less fatiguing for the user. The invention may be implemented as either a replacement for a conventional toe pedal, or as a wholly new design. In order to be attractive to users as a replacement, any replacement hi-hat actuator equipment should be capable of use with conventional hi-hat stands, replacing only minimal equipment. Many users are already familiar with the spring tension in the hi-hat that they have been using, and it would be attractive for a replacement actuator to leave intact the spring tension already in place. It is also helpful that the replacement actuator be capable of engagement simultaneously or virtually simultaneously with the conventional device, so that the user can easily switch back and forth between the two. Because of this simultaneity feature, the invention should occupy minimal space, due to the limited space available in a typical percussion set-up. It is also desirable that the actuator provide a high degree of adjustability, including variable rotation stroke, pedal angle and foot location with respect to the central stand.

Thus, an object of the invention is to facilitate actuation of a percussion instrument using a heel driven actuator. Another object of the invention is to permit a percussionist to locate the heel pedal of a hi-hat cymbal independently of the location of the cymbal stand, thus improving the percussionist's comfort. It is also an object of the invention to provide an actuator for a hi-hat cymbal that has excellent response time and sensitivity, with minimal or no bounce. Yet another object of the invention is to provide an actuator having an adjustable rest pedal angle and stroke. It is a further object of the invention to provide a heel driven hi-hat cymbal actuator that may be conveniently added to existing equipment, is lightweight, durable and conveniently collapsed for transport.

SUMMARY

In a preferred embodiment, the invention is an actuator for a percussion instrument that is sounded by motion of a sound initiation member, where the actuator includes a heel driven member, which translates vertically under the user's heel, and is connected to the sound initiation member, so that the user can activate the percussion instrument by moving the heel up and down. In a preferred embodiment, the percussion is a hi-hat cymbal. A preferred embodiment of the invention includes an inclined pedal that rotates about an axis as the heel driven member.

According to another preferred embodiment of the invention, the connection between the heel driven member and the sound initiation member is a hinged action lever, which is connected to the heel driven member so that it pivots in response to vertical heel motion. The action lever is connected to the sound initiation member by a cable, which is drawn in response to the pivoting motion of the action lever. The drawn cable pulls the sound initiation member, causing the instrument to sound.

Another preferred embodiment of the invention is an actuator for a percussion instrument having a heel driven member, which is connected electromagnetically to means for driving a sound initiation member. The driven sound initiation member causes the instrument to sound.

The invention will be more fully understood with reference to the following detailed description and the accompanying figures.

DETAILED DESCRIPTION

The inventors have discovered that significant advantages are provided by an actuator for a percussion instrument, such as a hi-hat cymbal, that is actuated by the user's heel. This new understanding is an aspect of the invention. Principally, heel tapping is less fatiguing and faster for a great many users. Tests confirm that higher frequency may be obtained by heel tapping than by toe tapping. Thus, the invention, in its broadest sense, is an actuator for a percussion instrument, such as a hi-hat cymbal, designed to accommodate heel driven actuation, or heel tapping, rather than toe driven actuation.

In order to accommodate vertical movement of the user's heel, a heel driven actuator must fit in among the other components of the percussion instrument to provide a free space adjacent the actuator that provides clearance for the user's leg. For instance, the prior art actuators shown in FIGS. 1, 2, 3 and 4 could not be used as heel driven actuators, because there is no clearance for the user's leg. If a user were to attempt to drive such a device by heel, the central cylinder 110, frame 116 and legs 112 would block the user's leg, so that he/she could not activate the pedal with the heel. Even if, by some bodily contortion, a user could activate such a pedal with the heel, the cymbals themselves 102 and 104 would interfere with the natural positioning of the user's upper body and the user would be unable to play the cymbals with hand-held sticks.

Typically, to provide enough free space around the heel driven actuator, it is arranged so that the heel driven portion is spaced away from the central cylinder 110, with free space adjacent to the side and adjacent to the heel end of the actuator. The heel end is the portion of the actuator most distant from the central cylinder.

Figure 1:
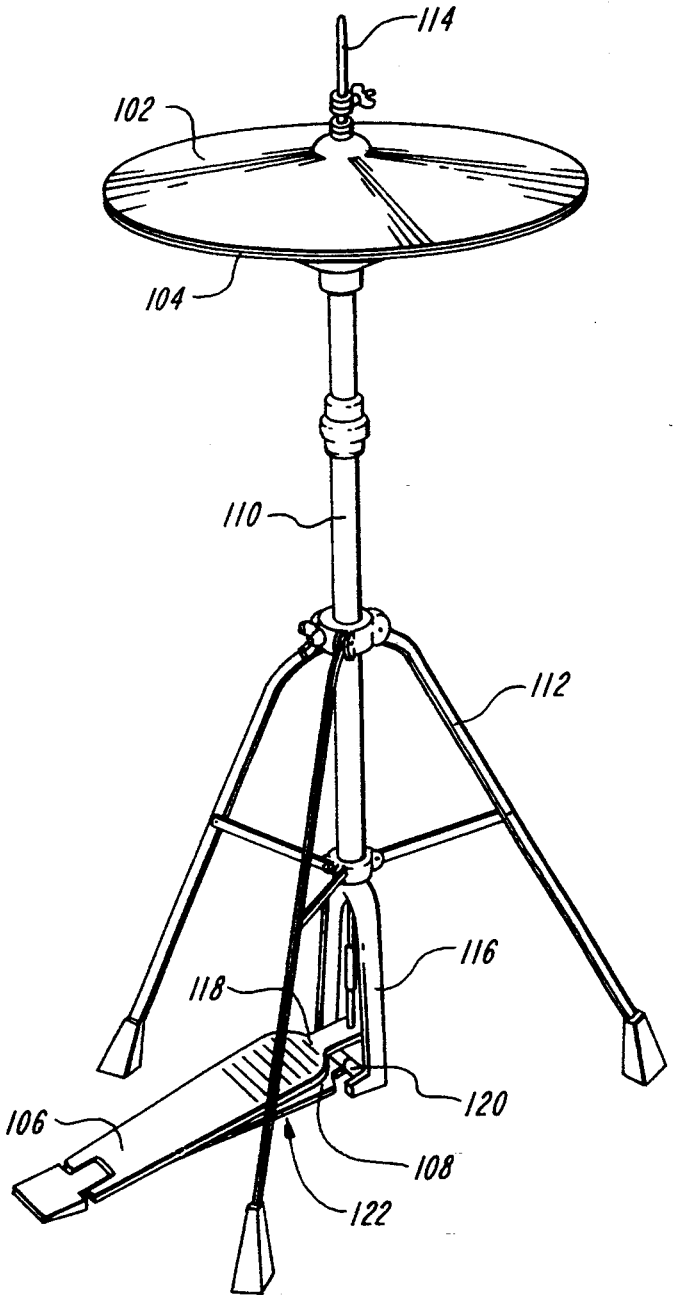
FIG. 1 (PRIOR ART)
FIG. 1 is a schematic, perspective view of a known hi-hat cymbal stand and toe driven pedal actuator.
Figure 2A:
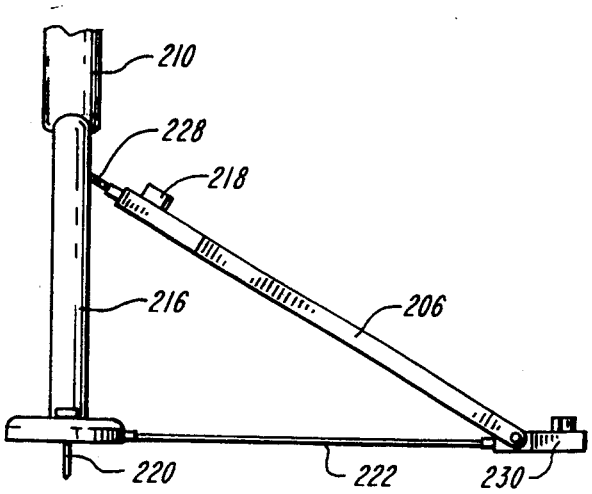
FIG. 2A (PRIOR ART)
FIG. 2A is a schematic side elevation view of a first type of known hi-hat cymbal actuator.
Figure 2B:
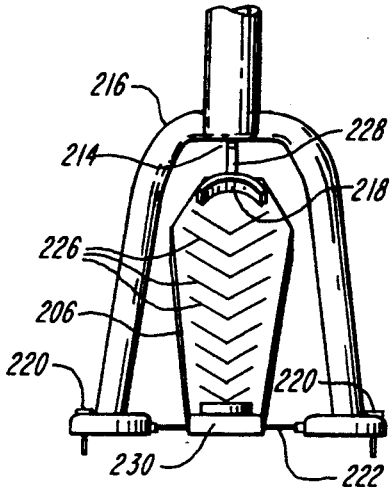
FIG. 2B (PRIOR ART)
FIG. 2B is a front elevation of the known hi-hat cymbal actuator shown in FIG. 2A.
Figure 3A:
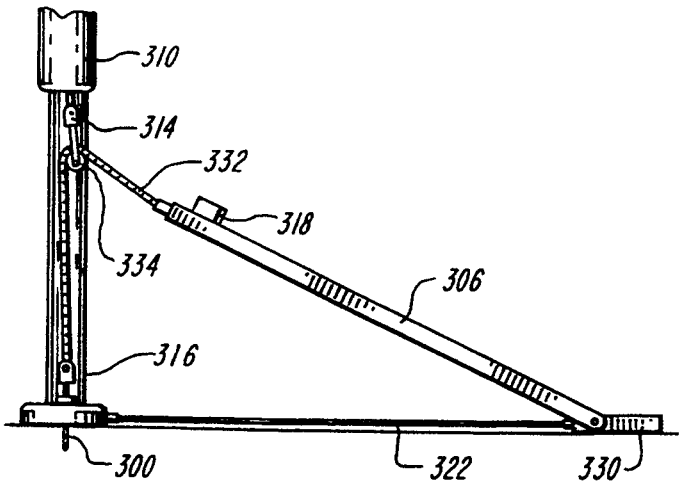
FIG. 3A (PRIOR ART)
FIG. 3A is a schematic side elevation view of a second, chain and pulley type of known hi-hat cymbal actuator.
Figure 3B:
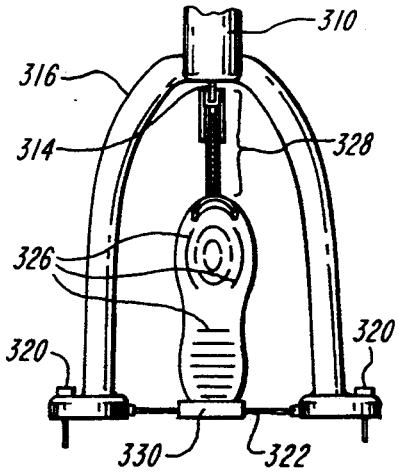
FIG. 3B (PRIOR ART)
FIG. 3B is a front elevation of the known hi-hat cymbal actuator shown in FIG. 3A.
Figure 4A:
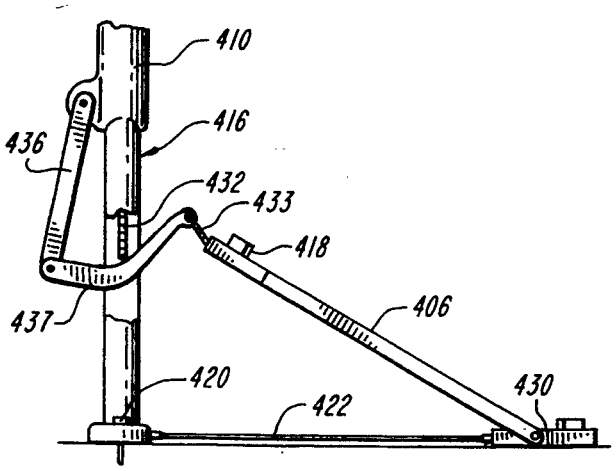
FIG. 4A (PRIOR ART)
FIG. 4A is a schematic side elevation view of a third, five-bar linkage type of known hi-hat cymbal actuator.
Figure 4B:
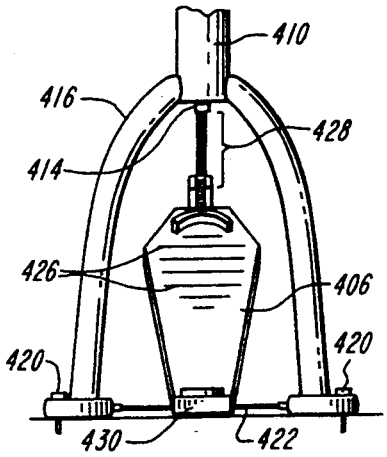
FIG. 4B (PRIOR ART)
FIG. 4B is a front elevation of the known hi-hat cymbal actuator shown in FIG. 4A.
Figure 5A:
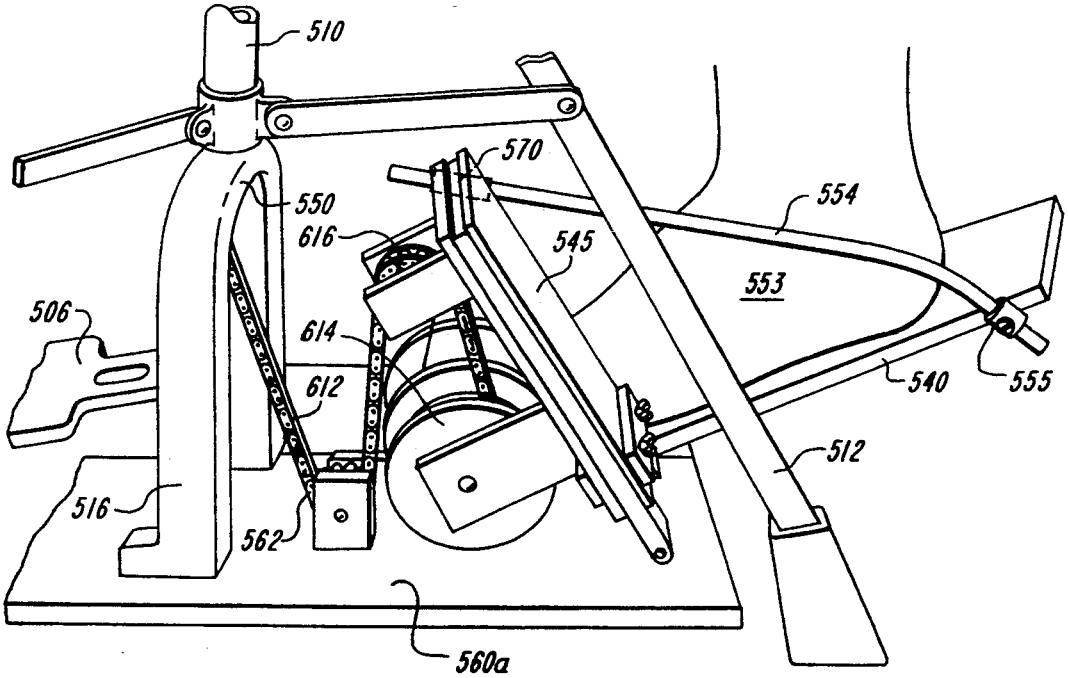
FIG. 5A is a schematic perspective view of a preferred embodiment of the invention shown from the user's left side, with a user's foot in position.
Figure 5B:
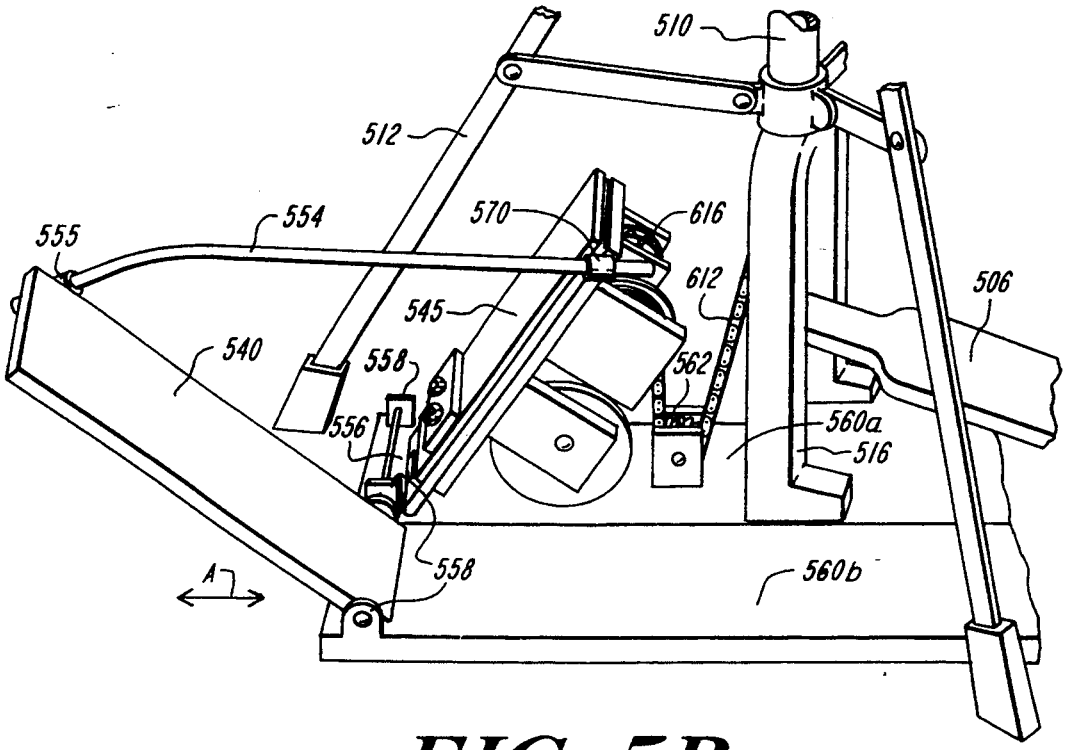
FIG. 5B is a schematic perspective view of the embodiment shown in FIG. 5A, shown from the user's right side, with no user's foot in position.
Figure 6A:
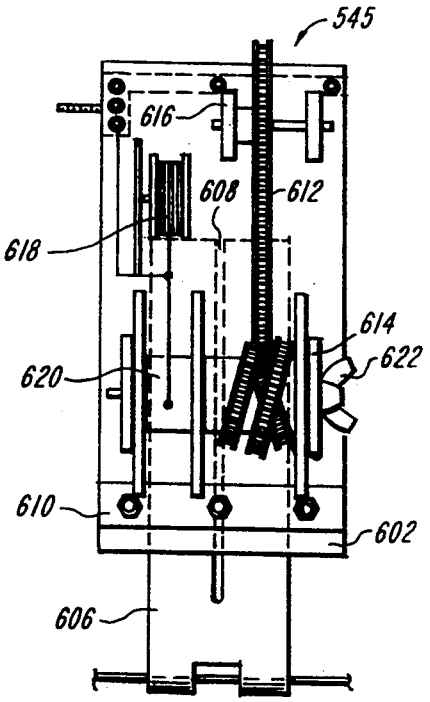
FIG. 6A is a schematic front elevation view of the action lever of the embodiment of the invention shown in FIG. 5A, with some parts shown in phantom.
Figure 6B:
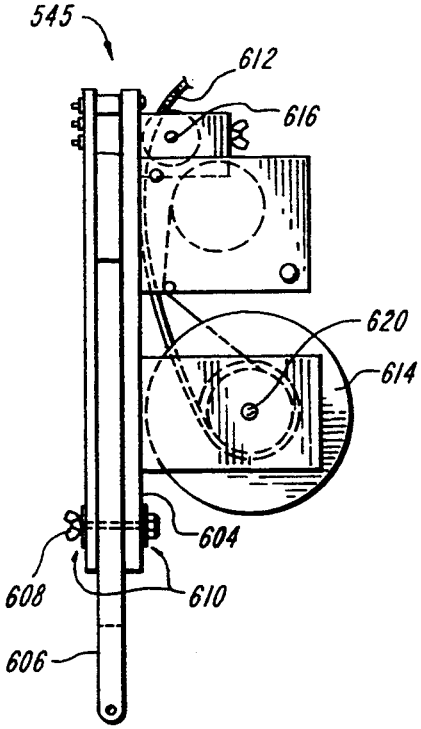
FIG. 6B is a schematic elevation view from the user's right side of the action lever of the embodiment of the invention shown in FIG. 5A, with some parts shown in phantom.

A preferred embodiment of the invention is shown schematically in FIGS. 5A and 5B. A principal component of the apparatus, referred to as the "action lever" is shown isolated in FIGS. 6A and 6B. References in the following discussion are to those figures.

The major components of a preferred embodiment of the invention include a base 560, a main portion of which 560*a*, is positioned under frame 516 of a conventional hi-hat assembly. Another, pedal portion 560*b* of base 560, is arranged generally parallel to and beside main base portion 560. The main base portion 560*a* supports an action lever 545.

An elongated heel driven pedal 540 is mounted on pedal base portion 560*b*, beneath and beside pedal frame 516. The pedal 540 is connected to action lever 545. The action lever 545 is generally elongated, with its long axis aligned with a radius from the center cylinder 510. The heel pedal 540 is arranged such that, as viewed from the top, its long axis is generally parallel to the long axis of the action lever 545. The action lever 545 and the heel pedal 540 can be arranged anywhere around the circumference of the central cylinder 510, with respect to the conventional pedal 506, so long as the elements do not physically interfere with the conventional pedal 506 and stand legs 512. The action lever 545 and the heel pedal 540 of the invention lie generally side-by-side. For an embodiment that is not designed to be used with a conventional toe driven pedal intact, it would not be necessary for the pedal 540 and action lever 545 to be arranged side by side. They could be in-line if on the same side as the center rod.

The pedal 540 is of a suitable material, such as aluminum. Other lightweight, strong materials are also suitable, such as composites—for instance, graphite. It may be wider at the lower portion, to provide for the width of the ball of the foot 552. The rest position of the pedal 540 relative to the ground can be adjusted between 0° and approximately 50° by sliding and locking pedal angle rod 554, which is secured by fitting 555 to the end of heel pedal 540 at one end, and to the action lever 545 near the other end. Rather than a rod, an adjustable turnbuckle, or other tension bearing, adjustable length member can be used. Fittings 555 and 570 allow a change in the angle between the rod 554 and either pedal 540 or action lever 545. Shortening the length of rod 554 between action lever 545 and pedal 540 increases the angle of the rest position of the pedal 540. After the rod 554 is locked to pedal 540 and action lever 545, the relative angle between pedal 540 and action lever 545 is fixed. The heel pedal 540 pivots or rotates about an axle 556, which is secured in blocks 558 mounted on pedal base portion 560*b*. An adjustable toe stop 562 mounted on pedal base portion 560*b* prevents the user's toe from going any further forward. Axle 556 may be mounted through suitable bearings to minimize noise and friction.

As used herein, a "heel" pedal is a pedal that can be arranged so that the user can apply his/her heel to the heel pedal without other parts of the percussion or actuating apparatus interfering with the user's body, particularly the leg. For instance, the conventional pedal of a hi-hat cymbal arrangement is not a "heel" pedal, because it is not possible to actuate the pedal with a user's heel, because the user's leg and body would interfere with the central support for the cymbal, and the cymbal itself. Also, it would be impossible for the percussionist to play the cymbals with sticks from this position, since the cymbals would be behind the percussionist. Similarly, as used in the claims, any means for activation by a user's heel must be similarly arranged with the necessary clearance.

The pedal 540 may be characterized by a heel edge (the elevated edge) and a toe edge (the opposite edge). In order to provide access for the user's leg, a free space is provided adjacent to the side of the heel edge. The free space is generally above and at the same level as the heel edge and sufficiently large to accommodate the user's leg. The location of the heel pedal relative to the central cylinder must also provide clearance for the user's body with respect to the cymbals and other elements of the percussion instrument. Typically, the heel edge of the heel pedal is the portion of the heel pedal most distant from the central cylinder.

The action lever 545 is fixed to the main portion 560*a* of pedal base 560 through axle 556, which is also the axle about which pedal 540 pivots (although this identity of axle is not required). As the heel pedal 540 is depressed, the top of action lever 545 is drawn backward toward the pedal (and the user), due to the linkage through the pedal angle rod 554. The action lever 545 is shown in more detail in FIGS. *6a* and *6b*.

Two shell plates 602 and 604 sandwich a core 606. The core is slotted and the shell plates 602 and 604 can be slid along the length of the core 606 to a desired position. The shell plates are secured to the core 606 by a bolt 608 or other suitable means that clamp a pair of compression plates 610. Varying the longitudinal position of the shell plates 602 and 604 with respect to the core 606 changes the length of the action lever and thus changes the sensitivity of the heel pedal 540 by adjusting the total lever length. A relatively shorter action lever provides relatively less cymbal motion for the same pedal motion, i.e. relatively higher stroke/cymbal travel ratio, and thus, relatively more sensitivity. In other words, a relatively shorter action lever requires more pedal motion for the same cymbal motion. The length of the action lever can be easily changed during set-up of the actuator to accommodate the user's taste or needs.

A cable 612 is optionally stored on spool 614 on the action lever from which it passes around an intake sprocket 616 fixed to the action lever 545. The purpose of the intake sprocket 616 is to spread the load from a small number of links of cable 612 to a larger number of links, i.e. those links that are in contact with teeth around the perimeter of the sprocket. If a stronger cable is used, the intake sprocket 616 is not necessary, and any simple connection may be used. From intake sprocket 616, the cable passes to an idler sprocket 562, which is mounted on main base portion 560*a*. This idler sprocket 562 has an adjustable position with respect to the main base 560*a* (in the directions of arrows A). This is so that the idler sprocket 562 can always be located as close as possible to the axis of the center rod, regardless of where the user has moved base 560, and thus pedal 540 and action lever 545 for other comfort purposes.

Suitable cable for connecting the action lever 545 to the central cylinder is available from Winfred M. Berg, Inc., 499 Ocean Ave., East Rockway, N.Y. 11518 as series #25CCF from catalogue B8 of mechanical components. Typical is a 1/32 in. (0.08 cm.) stainless steel cable chain coated with polyurethane, capable of withstanding at least 100 lb. of tension during operation. The cable chain has two strands of metal cable, coated with polyurethane. Polyurethane coated metal connectors join the two cables like rungs on a ladder. The cable has zero backlash, silent drive, and requires no lubrication. This heightens sensitivity and eliminates messy assembly, noisy chains and metal-on-metal wear. The cable also functions when twisted, allowing stand rotation of nearly 45 degrees around the central cylinder axis, if necessary. Other suitable cables of the same general design operate under loads of up to three hundred pounds of tension. Choice of a cable capable of withstanding at least 200 lbs. of tension is recommended. Suitable sprockets are designed to work with the chain, from the same catalogue. They are anodized aluminum and provide no-slip conditions when used with the cable mentioned above.

The base 560, which carries axle 556, about which both the action lever 545 and the heel pedal 540 pivot, can be moved circumferentially with respect to central cylinder 510, as well as radially in the directions indicated by arrows A. By moving the base 560, action lever 545, and heel pedal 540 away from center cylinder 510, the drummer can independently adjust the location of his/her foot and seat, and thus the degree of leg extension. With prior art systems, the location of the cymbal stand dictates the location of the pedal, and thus the foot. Seat position is often constrained by other considerations; thus, the drummer would have little control over the degree of leg extension.

Figure 7A:
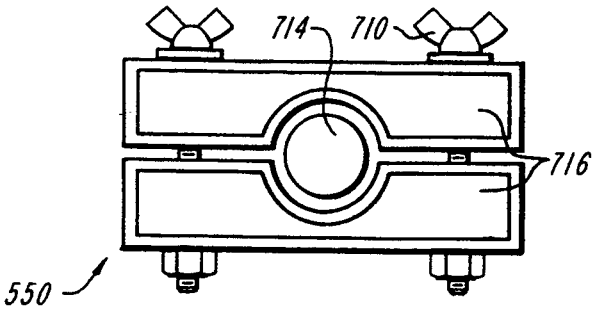
FIG. 7A is a top plan view showing a preferred embodiment of a connector for connecting the heel pedal of the invention to the central rod of a conventional hi-hat assembly.
Figure 7B:
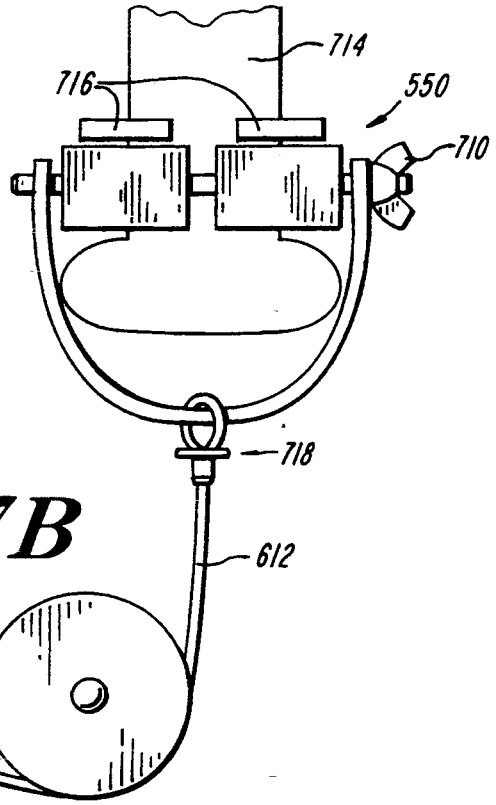
FIG. 7B is a side elevation view of the connector shown in FIG. 7A.

From the idler sprocket 562, the cable 612 passes to a connector 550 (partially hidden in FIG. 5, shown more fully in FIGS. 7A and 7B). The connector 550 is a small rectangular fixture, similar to a shaft clamp, that clamps to the center rod 714 of a conventional cymbal arrangement and connects to the end of cable 612. It may be fixed by wing nuts or set screws, or other suitable means. For an embodiment of the invention which is adaptable to prior art devices, it is beneficial that the connector should be removable. It is also beneficial to design the connector so that it can remain attached to the center rod without affecting normal operation of a conventional, toe driven cymbal. In such a case, the cable 612 must be removable, by some releasable fitting 718, such as a screw clamp, ball and socket, etc. For non-adaptable embodiments, the connector can be fixed more permanently to the center rod 714.

The upper surface of the connector should generally mate with the under surface of pedal frame 550, so that no lateral forces are induced in the center rod. Lateral forces can tilt the center rod of the axis of the central cylinder 510, causing damage, noise, or wear inside the cylinder. Temper foam 716 is mounted between the top of the connector and the pedal frame 516 to dissipate the energy from the return spring and eliminate bounce. Temper foam is a polyurethane, open cell viscoelastic foam that dissipates energy as it is compressed, so that there is very little potential spring energy to be released after the center rod stops moving upward. Such a foam is available from Alimed Inc., doing business as Temperfoam, of 297 High Street, Dedham, Mass., 02026. Ideally, a mechanism is provided so that tension applied to cable 612 results in a force applied to central rod 714 that is nearly co-linear with the central axis of center rod 714.

The basic operation of the pedal is as follows: the user depresses heel pedal 540 with his/her heel, which causes the pedal angle rod 554 to be drawn backward. Pedal angle rod 554 is attached to the top of action lever 545, which is accordingly drawn backward (toward the user) also through the same angle through which the pedal 540 travels. Take-up reel 614 is fixed against rotation, so that no additional slack cable 612 can be reeled from it as it moves backward. Consequently, intake sprocket 616 moves backward with the top of action lever 545, drawing cable 612 back with it. As the cable 612 is drawn back, the portion of the cable between idler sprocket 562 and connector 550 is drawn down, pulling the connector 550 down with it. The connector 550 is attached to the center rod of the cymbal assembly, which is in turn attached to the upper cymbal. Thus, depression of the heel pedal 540 causes the upper cymbal to meet the lower cymbal, thereby sounding the cymbals.

Adjusting the length of the portion of cable 612 that is between the reel 614 and the connector 550 is necessary for several reasons. If the user wants to keep the central cylinder 510 in a desired location, due to the location of other percussion equipment, etc., but wants to move the location of his foot, he can move the pedal 540, action lever 545 and base 560 forward or backward. (Idler sprocket 562 remains in approximately the same location relative to the central cylinder 510.) Thus it is movable relative to central base portion 560*a*, such as by a locking peg and hole system. Therefore, the length of the cable 612 must be adjustable. However, once the desired adjustment has been made, the length of the cable 612 must be kept constant, so that when the action lever 545 moves, the connector 550 will also move. Thus, the spool 614 must be locked to prevent further lengths of the cable 612 from being extended. To facilitate the feeding and take-up of extra cable 612, a take-up mechanism 618 is provided, by a constant torque spring, which pulls on the shaft 620 upon which spool 614 is mounted, but in the opposite direction from the pull applied by cable 612. A suitable spring is available from Stock Drive Products, part #3253-ML3943, which extends a 0.024 in (0.06 cm) wide stainless steel cable to 68 in. (173 cm.) in length while maintaining a nearly constant ½ lb force.

Once the cable has been extended to its desired length, a wing nut 622 or other securing device is tightened and no further rotation of the spool 614 is permitted. Cable stress is minimized because the cable 612 runs over intake sprocket 616 and idler 562, thereby spreading the pulling force over several sprocket teeth.

Due to the foregoing features, the invention provides the reliability and adjustability desired. Because it is activated by the user's heel, rather than toe, fatigue is minimized and accuracy, power, and frequency stability are enhanced. The temper foam reduces bounce. The cable 612 is essentially inextensible with respect to the forces in question, so the feel of the device is very good. The distance between the user and the cymbal stand and the degree of leg extension can be adjusted by adjusting the location of the base 560 and the action lever 545 and heel pedal 540. The heel pedal 540 rest angle may be adjusted by changing the length of pedal angle rod 554 (through a turnbuckle or similar component) between the pedal 540 and the action lever 545.

The sensitivity of the actuator can be adjusted by adjusting the length of the action lever 545 between the axle 556 and the connection point 570 of pedal angle rod 554, by sliding the shell plates 602 and 604 along the length of core 606. (A relatively longer action lever moves through a larger arc than does a shorter action lever, for the same degree of depression of the heel pedal 540. Relatively greater motion of the action lever is translated into relatively greater motion of the cable 612 and thus the cymbal. Thus, increasing the length of the action lever decreases the stroke to cymbal travel ratio and thus decreases the sensitivity. In other words, if the action lever is longer, the actuator is less sensitive, having a larger output of center rod motion for a given input of heel motion.)

The foregoing has described an actuator intended to replace a conventional toe driven actuator. Those of ordinary skill in the art of percussion instrument design will understand that the components described are exemplary, but not required. For instance, the main component is the heel pedal, which has as its output the rotation of the heel pedal around axle 556. The desired input to the cymbal is a downward motion on the center rod. This is provided by cable 612. The additional mechanism of the action lever 545, and the idler 562 merely serve to change the rotation of the heel plate 540 into the downward motion of the cable 612. Any other suitable linkage that accomplishes this transduction is within the contemplation of the invention.

If an action lever is used, it is not necessary to use a take-up spool and constant tension spring. This embodiment may be useful when great degrees of adjustment of the length of the action lever and the position of the lever and pedal are desired. However, for less adjustable situations, a simpler mechanism is suitable, capable of taking up a few inches of cable, such as a linear spring. Further, if a stronger cable is used, an intake sprocket is not required.

The invention also contemplates embodiments that are not replacements for known designs. In such an embodiment, more space is available for the invention. The arrangement of the heel pedal and the action lever can be more generally collinear, with both located on the same side of the center shaft. Rather than a cable, any linkage that avoids backlash and play can be used.

It is also desirable that the invention be usable either on the user's left or right sides. This can be accomplished by providing dual connection points on both the heel pedal 540 and the action lever 545 for the pedal angle rod 554, and the two piece base plate 560, a main portion 560*a* for supporting the action lever and the pedal portion 560*b* for supporting the heel pedal. The two pieces are designed so that the pedal support portion can be located on either side of the action lever support portion. Alternatively, both pieces can be identical, each bearing fittings for both the action lever and the pedal, which are, in turn, designed to be connected on either side.

The heel pedal need not be in the form of a lever that pivots about one end. Rather, it can constitute a mechanism which simply translates vertically up and down. The mechanism is attached to a component analogous to the action lever. However, in this embodiment, it is pure vertical translation of the heel pedal that is to be transduced into the vertical motion of the central rod.

Figure 8:
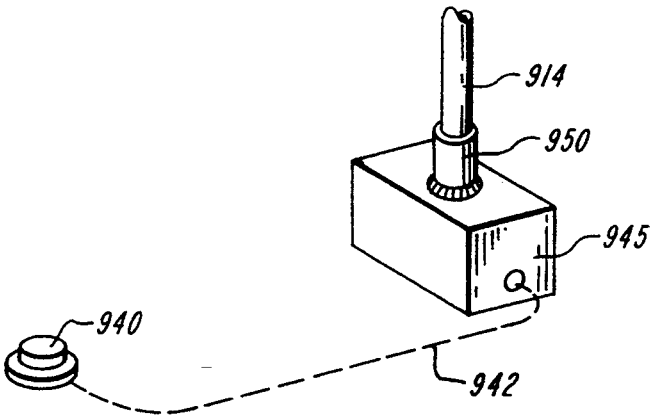
FIG. 8 is a schematic representation of a third preferred embodiment of the invention, including a means for transmitting an electromagnetic signal from the heel pedal to the central rod of a conventional hi-hat assembly.

A principal aspect of the invention is the use of a heel activated pedal rather than a toe activated pedal. Any mechanism that transduces vertical heel translation into the translation of the central rod of the cymbal is within the contemplation of the invention. For instance, the heel pedal can constitute an electric switch 940, as shown in FIG. 8. The user presses his/her heel against switch 940, which transduces the heel translation into an electromagnetic signal, such as an electric signal that is transmitted over line 942, such as a cable. The signal is received by a electro-mechanical transducer 945, for instance a stepping motor or a solenoid, which transduces the electric signal into a mechanical translation of connector 950. Connector 950 is connected to central rod 914 of the cymbal. Upon vertical translation of the connector 950, the central rod 914 translates vertically, causing the cymbal to sound.

The electromagnetic signal need not be electric, but may rather be, for instance, optical, or any other form of electromagnetic energy that can be transmitted through a practical channel 942 over the distances and at the size scales relevant to a drum set. A possible drawback of such a system where the signal from the heel pedal to the central rod of the cymbal is electromagnetic, rather than a mechanical signal (such as a displacement) is that the user has no feedback. Therefore, this embodiment may be used with a feedback mechanism, or in situations where none, or little feel is necessary.

The actuator can also be used with any other percussion instrument that is normally activated by a pedal, such as a bass drum. It is not necessary that the instrument have a vertically movable sound initiation member analogous to the center rod of a hi-hat cymbal. All that is required is that the instrument have a movable sound initiation member, such that the rotation, or downward displacement of the heel pedal can be transduced into the motion of the sound initiation member. The invention can even be used with a rotary sound initiation member if an appropriate linkage is provided. Design of such linkages is within the skill of an ordinary practitioner of the art.

The foregoing discussion should be understood as illustrative and should not be considered to be limiting in any sense. While this invention has been particularly shown and described with references to preferred embodiments thereof, it will be understood by those skilled in the art of percussion instrument design that various changes in form and details may be made therein without departing from the spirit and scope of the invention as defined by the claims.

Having described the invention, what is claimed is:

1. An actuator for a percussion instrument having a movable sound initiation member, the actuator comprising:
   a. base adapted to rest upon the ground;
   b. a pedal having a heel pad free to be displaced vertically toward and away from the base in response to vertical displacement of a user's heel toward and away from the base;
   c. connected between the pedal and the sound initiation member, a means for transducing a vertical displacement of the heel into a motion of the sound initiation member; and
   d. means for adjusting the degree of motion of the sound initiation member that is transduced in response to a specified degree of vertical displacement of the heel pad.

2. An actuator for a percussion instrument having a movable sound initiation member, the actuator comprising:
   a. base adapted to rest upon the ground;
   b. a pedal having a heel pad free to be displaced vertically toward and away from the base in response to vertical displacement of a user's heel toward and away from the base;
   c. connected between the pedal and the sound initiation member, a means for bearing tension having a first end connected to the sound initiation member and a second end connected to the heel pad for transducing a vertical displacement if the heel pad into a motion of the sound initiation member; and
   d. means for connecting the second end of the tension bearing means to the pedal, comprising:
      i. an action lever having a first end that is fixed relative to the pedal and a second end that is rotatable around the first end and means for varying the distance between the first and second ends of the action lever;
      ii. means for connecting the second end of the action lever to the heel pad; and
      iii. means for connecting the second end of the tension bearing means to the action lever.

3. The actuator of claim 2 the means for varying the distance between the first and second ends of the action lever comprising a core member and at least one shell member, slidably and lockably connected to each other.

4. An actuator for a percussion instrument having a movable sound initiation member, the actuator comprising:
   a. a base adapted to rest upon the ground;
   b. a pedal having a heel pad that is free to be displaced vertically toward and away from the base in response to vertical displacement of a user's heel toward and away from the base, the heel pad having a rest position defined by the distance the heel pad is spaced from the base;
   c. connected between the pedal and the sound initiation member, a means for transducing a vertical displacement of the heel into a motion of the sound initiation member; and
   d. means for varying the rest position of the heel pad.

5. An actuator for a hi-hat cymbal, with a sound initiation member that is a vertically movable central rod, the actuator comprising:
   a. a base adapted to rest upon the ground;
   b. a pedal having a heel pad free to be displaced vertically toward and away from the base in response to vertical displacement of a user's heel toward and away from the base; and
   c. connected between the pedal and the central rod, a means for bearing tension having a first end connected to the central rod and a second end connected to the heel pad, the means for bearing tension arranged so that a displacement of the heel pad causes a motion of the central rod.

6. An actuator for a percussion instrument having a movable sound initiation member, the actuator comprising;
   a. a base adapted to rest upon the ground;
   b. a pedal having a heel pad free to be displaced vertically toward and away from the base in response to vertical displacement of a user's heel toward and away from the base;
   c. connected between the pedal and the sound initiation member, a means for bearing tension having a first end connected to the sound initiation member and a second end connected to the heel pad for transducing a vertical displacement of the heel into a motion of the sound initiation member; and
   d. means for connecting the second end of the tension bearing means to the pedal, comprising:
      i. an action lever having a first end that is fixed relative to the pedal and a second end that is rotatable around the first end;
      ii. a rod for connecting the second end of the action lever to the heel pad; and
      iii. means for connecting the second end of the tension bearing means to the action lever.

7. An actuator for a percussion instrument having a movable sound initiation member, the actuator comprising:
   a. a base adapted to rest upon the ground;
   b. a pedal having a heel pad free to be displaced vertically toward and away from the base in response to vertical displacement of a user's heel toward and away from the base;
   c. connected between the pedal and the sound initiation member, a means for bearing tension having a first end connected to the sound initiation member and a second end connected to the heel pad for transducing a vertical displacement of the heel into a motion of the sound initiation member; and
   d. means for connecting the second end of the tension bearing means to the pedal, comprising:
      i. an action lever having a first end that is fixed relative to the pedal and a second end that is rotatable around the first end;

ii. a turnbuckle for connecting the second end of the action lever to the heel pad; and iii. means for connecting the second end of the tension bearing means to the action lever.

8. An actuator for a percussion instrument having a movable sound initiation member, the actuator comprising:

a. a base adapted to rest upon the ground;

b. a pedal, comprising:

i. a toe end; and ii. a heel pad, free to be displaced vertically toward and away from the base in response to vertical displacement of a user's heel toward and away from the base, the heel pad of the pedal being rotatable about an axis at the toe end;

c. means for supporting the pedal relative to the ground such that in a rest position, the pedal is inclined to the ground, with the heel pad elevated relative to the toe end; and d. a means for bearing tension for transducing a vertical displacement of the heel into a motion of the sound initiation member, said tension bearing means connected at a first end to the sound initiation member and at a second end to the pedal, comprising:

i. a vertically movable central rod arranged so that a displacement of the heel pad causes a motion of the central rod; and ii. means for connecting the second end of the tension bearing means to the pedal, comprising:

(a) an action lever having a first end that is translationally fixed relative to the pedal and a second end that is rotatable around the axis of rotation of the pedal, which passes through the first end of the action lever; and (b) means for connecting the second end of the action lever to the heel pad.

9. An actuator for a percussion instrument having a movable sound initiation member, the actuator comprising:

a. a base adapted to rest upon the ground;

b. means for generating a heel displacement signal in response to vertical displacement of a user's heel toward and away from the base; and c. connected between the means for generating a heel displacement signal and the sound initiation member, a means for transducing a heel displacement signal into a motion of the sound initiation member, the means for transducing comprising:

i. means for transducing a heel displacement signal into an electromagnetic signal;

ii. connected to the sound initiation member, means for transducing an electromagnetic signal into motion of the sound initiation member; and iii. means for electromagnetically connecting the means for transducing a heel displacement signal into an electromagnetic signal to the means for transducing the electromagnetic signal into motion of the sound initiation member.

10. An actuator for a hihat cymbal having a movable sound initiation member, the actuator comprising:

a. a base adapted to rest upon the ground;

b. a heel pad, having a toe facing edge and a heel facing edge;

c. connected between the heel pad and the sound initiation member, a means for transducing vertical motion of the heel facing edge into a motion of the sound initiation member where the heel pad is arranged such that clearance is provided to free a user's leg and torso from interference with the cymbal and means for transducing heel pad motion when a user's heel is placed upon the heel pad adjacent the heel facing edge and with the users's toes pointing in the direction of the toe facing edge.

11. The actuator of claim 10, said means for transducing comprising a cable with a first end connected to the sound initiation member and a second end connected to the heel pad.

12. The actuator of claim 11, said means for transducing further comprising an action lever, translationally fixed relative to the heel pad, having a free end and a fixed end, with the free end connected to one end of the cable and to the heel edge of the heel pad.

* * * * *